US006369697B1

(12) United States Patent
Poole

(10) Patent No.: US 6,369,697 B1
(45) Date of Patent: Apr. 9, 2002

(54) TIMING METHOD AND APPARATUS FOR SPORTS EVENTS

(76) Inventor: Trevor Poole, 50 Douglas Road, Brickhill (GB), MK41 7YH ( * ) Notice: Subject to any disclaimer, the term of this patent is extended or adjusted under 35 U.S.C. 154(b) by 0 days.

(21) Appl. No.: 09/345,816

(22) Filed: Jun. 30, 1999

(51) Int. Cl.[7] ..... G08B 1/00

(52) U.S. Cl. ..... 340/309.15; 340/825.69; 368/11

(58) Field of Search ..... 340/309.15, 323 R, 340/539, 825.69, 825.72; 368/11, 113

(56) References Cited

U.S. PATENT DOCUMENTS

| | | | | | |
|---|---|---|---|---|---|
| 3,651,507 | A | * | 3/1972 | Abbott | 340/323 R |
| 4,045,788 | A | * | 8/1977 | Castelli et al. | 340/323 R |
| 4,263,736 | A | * | 4/1981 | Beierwaltes et al. | 340/323 R |
| 4,526,479 | A | * | 7/1985 | Harris | 368/108 |
| 4,535,333 | A | * | 8/1985 | Twardowski | 340/825.69 |
| 5,027,102 | A | * | 6/1991 | Sweeny | 340/323 R |
| 5,084,695 | A | * | 1/1992 | Freeman | 340/323 R |
| 5,293,354 | A | * | 3/1994 | Costabile | 368/11 |
| 5,898,587 | A | * | 4/1999 | Bell et al. | 340/323 R |

* cited by examiner

*Primary Examiner*—John A Tweel
(74) *Attorney, Agent, or Firm*—Ira S. Dorman

(57) ABSTRACT

The timing system for a game or timed event comprises a mobile device (1) including a transmitter (4) adapted to transmit a wireless electromagnetic radiation signal from the field of play. At least one receiver (5) is located outside the field of play in any one direction to a maximum distance allowed by radio frequency laws to receive such signal. Each of the device (1) and the main scoreboard (2) has a timer system (9, 10), adapted alternately to start and stop timing in response to each actuation signal from switch (3). Hence any interruption of time played in the game is made visible and conveyed to the supporters in an unambiguous way, and which allows the umpire or referee on the field to control the game absolutely.

With a further need to improve refereeing decisions an addition to the system, a 4th official device (A) also located outside of the field of play in a game or timed event, that includes:—A receiver (B) adapted to receive signals from the mobile device transmitter (4). A transmitter (d) adapted to transmit electromagnetic radiation signals to mobile device receiver (E) in the field of play, in response to each actuation signal of switch (C). On receipt of a signal from transmitter (0) a message will be displayed to the referee or umpire on display screen (F), thus ending all human errors in refereeing decisions.

13 Claims, 4 Drawing Sheets

TIMING METHOD AND APPARATUS FOR SPORTS EVENTS

BACKGROUND OF THE INVENTION

The present invention relates to a method and apparatus for the timing of sporting events. More particularly, but not exclusively, it relates to a timing system under the control of referees, umpires or the like and displayable to a watching crowd.

Accurate timing of field sports and other activities is an essential element of "fair play". A typical sport may involve one or a number of periods of play of predetermined duration. For example, in Association Football, two halves of forty-five mintures each are played. In some games, extra time is needed to decide a result, in which case the periods for each half of extra time are set at a lesser time, such as fifteen minutes. In the event of an injury to a player or other good reason for stopping the game (e.g. time wasting by one team), the referee, which term is herein used to indicate any official having charge of the sporting event, especially one on the field of play, will stop his wrist or pocket stopwatch and restart it when play resumes.

Hence the time played is known only to the referee. The spectators are left, at the end of the normal period of play, which they can determine, with an expectation that the game will continue for an indeterminate, to them, period of time "allowed" for stoppages. This lack of determination leaves room for many arguments, especially when a score is made during the extended period of play.

The sport may involve the accumulation of scores throughout the playing time of the fixture. Any reduction in time played per period could result in an "unfair" final score. Likewise any "overplay" could also produce an "unfair" final score.

The continuing trend across all sports is the transition from amateur to professional status. This professional status brings with it prospects of revenue based on the relative performance of a sports team or individual. The financial rewards for success can be considerable, likewise the financial penalties for failure. It is essential therefore that the timing of such sports periods shoud be impartial and beyond reproach.

Many sports have either umpires or referees to ensure impartiality with regard to timing. Problems exist, however, where spectators and commentators, whose perception of time may be at fault for emotional reasons, cannot agree on exactly how much time has been played.

Most sports have a true and loyal following of supporters. Any ambiguity in the amount of time played can occasionally lead to dissent and unsavoury behaviour between opposing supporters This may lead to financial penalties being incurred by the professional clubs (i.e. increased policing of events, exclusion from tournaments) and other losses of revenue. With many top clubs functioning as corporate bodies this can directly affect the "attractiveness" of the business.

SUMMARY OF THE INVENTION

It is an object of the present invention to provide a method and apparatus for timing events which permits the umpire's or referee's interruption of time played to be made visible and conveyed to the supporters in an unambiguous way, and which allows the umpires or referrees on the field still to control the game absolutely.

According to the present invention there is provided a timing system for a sports game or other timed spectator event, which system comprises:

at least one mobile device having a switch means and a transmitter means responsive to the switch means and adapted to transmit a wireless electromagnetic radiation signal from the field of play;

at least one receiver means located outside of the field of play, but not surrounding the field of play, to receive said signal and emit an actuation signal in response thereto;

a timer associated with the receiver means and adapted alternately to start and stop timing in response to each actuation signal from said at least one receiver means;

and time display means outside the field of play to display the output from the timer, the mobile device having its own timer display means adapted to respond to operation of the switch means to provide a simultaneous timing display on the mobile device.

Preferably the transmitted signal is radiation in the infra red or radio range.

The mobile transmitter device may be a wrist worn or pocket held mobile unit including a transmiter and a switch, preferably under manual control of an official of a timed game being played.

The or each receiver means may be located adjacent or beyond a boundary of the field of play.

The transmitted signal may be simply a start/stop signal.

Alternatively, the transmitted signal may be of such a selected frequency as to cause selective actuation by the received means of a predetermined display in addition to or replacing the timer display.

The frequency of transmission between the controller and the receiver may be so coded as to prevent interference from alternative transmission means.

According to a second aspect of the present invention there is provided a timing system for a sports game or other timed spectator event, which system comprises:

a mobile device having a switch means and a transmitter means responsive to the switch means and adapted to transmit a wireless electromagnetic radiation signal from the field of play;

at least one receiver means located outside of the field of play, but not surrounding the field of play, to receive said signal and emit an actuation signal in response thereto;

a timer associated with the receiver means and adapted alternately to start and stop timing in response to each actuation signal from said at least one receiver means;

and time display means outside the field of play to display the output from the timer, the transmitter being adapted to selectively transmit a signal of such a selected frequency as to cause selective actuation by the receiver means of a predetermined display in addition to or replacing the timer display.

Preferably the receiver and the time display outside the field of play are mobile.

Preferably the receiver means located outside the field of play can be adapted to accept any time means of display already in use in stadia.

Preferably at least one signal transmits a pseudo-random number from over 16 million possible combinations and changes combination on each actuation of the mobile device switch.

Suitably an additional device is located outside the field of play under control of an official including a receiver adapted to receive signals from the mobile device(s) in the field of play, a switch and a transmitter means responsive thereto and adapted to transmit signals to the said mobile device(s).

Preferably said additional device has a light or buzzer to indicate when a signal has been transmitted or received thereby.

Advantageously a signal block in the timer system allows only one mobile device to control said timer system while the countdown is in stop mode.

Preferably more than one mobile device is used in the field of play and each can transmit and receive signals from one another, stopping and starting the time display in said mobile devices.

Suitably this mobile device(s) is adapted to display messages transmitted from outside the field of play.

DETAILED DESCRIPTION OF THE ILLUSTRATED EMBODIMENTS

Figure 1:
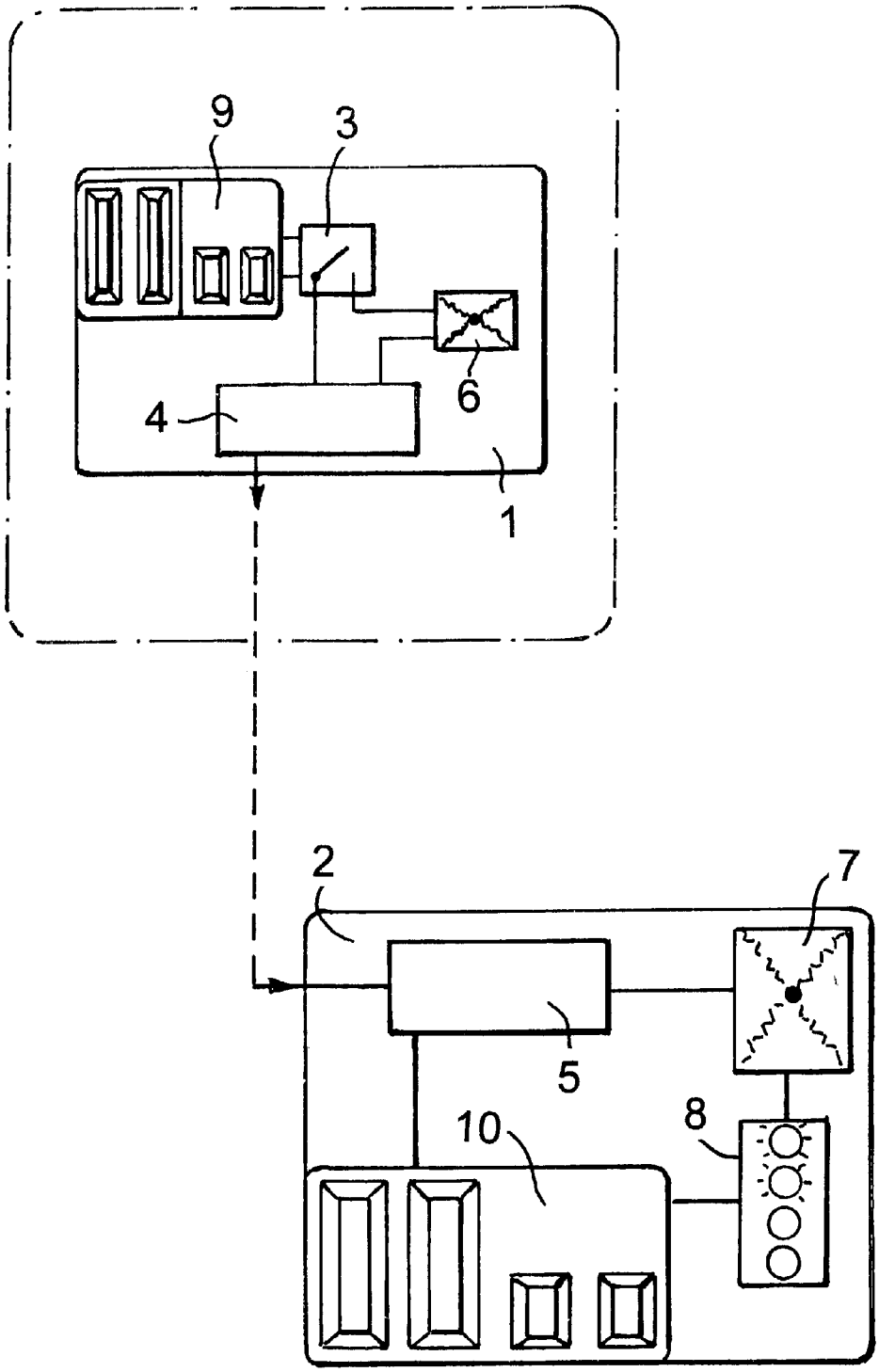
FIG. 1—shows schematically the system of the invention for a game of field sport under control of one referee or umpire.

An embodiment of the present invention will now be more particularly described, by way of example, and with reference to the accompanying drawings. FIG. 1 of which shows schematically the system of the invention.

Referring now to the drawing there is provided a stopwatch device 1, which is designed to be lightweight and unobtrusive. The device 1 may take the form of a modified wristband unit or pocket device which is lightweight and will not be an obstruction or burden to the umpire or referee, by whom it is carried. The device 1 includes a transmitter 4 capable of transmitting a timing/non-timing instruction signal to receiver 5 via a radio frequency link, infra red or other suitable transmission media, over a distance up to 200 m. The signal is initiated by operation of switch 3 on the mobile device 1. A buzzer 6, sounding for 1 sec. is incorporated in the circuit to alert the referee when the switch 3 is used.

The signal emitted from the transmitter 4 is coded (to prevent unauthorised interference) and sent to receiver 5 which is suitably equipped with a compatible decoder. Upon receipt of a valid signal from the device, the receiver will actuate a main display clock 10 appropriately to start or stop, as the case may be.

The mobile device 1 is also provided with a time display 9, also actuated to start or stop by operation of switch 3. A klaxon 7 and/or a light 8 may be provided at the main scoreboard 2 to alert spectators to a change of status.

An application of the invention will now be described in detail with respect to professional football. However, the invention is equally applicable to other timed games such as rugby, football, hockey, ice hockey. American football and the like. It may even be applicable to timed quiz games, such as Mastermind and the like.

Extra mobile devices can be used in sports games or timed events that use more than one referee or umpire.

In this application the controller or mobile device is carried by the referee in the pocket or is wrist worn. The receiver S and countdown time 10 are mounted at a convenient location, off the field of play but within the stadium, preferably within the existing score and other information displays. The range of such a system would permit the referee to change the status of the countdown timer from any location as defined by the playing area (the pitch). To this end the desirable range will be up to 150–200 metres. The frequency of the transmission is preferably, but not necessarily, in the range of 350–500 MHz, ideally 418 MHz.

The system will operate in the following manner. Immediately before the commencement of play, the countdown timer will be pre-set to forty five minutes duration. Upon starting the football playing half the referee uses the switch 3 in the controller 1 to change the status of the clocks 9 and 10, i.e. causes the countdown timers to decrement. If no further interruption of play becomes necessary then a Klaxon 7, flashing light 8 or suitable annunciation will be sounded after forty five minutes, i.e. when the timers 9 and 10 reach zero. Should it become necessary to interrupt play the referee will change the status of the system by operation of the switch 3, causing the countdown timers to "freeze" the timing period. When the referee is satisfied that play may continue the switch utilised to "unfreeze" both countdown timers. The game may continue to the conclusion of forty-five minutes. The process interruption-resumption may occur many times.

The countdown timer may be displayed on a screen viewable by the spectators and, indeed, the participants. Stoppage time will be clearly indicated and the commencement and end of each stoppage period can be seen by all. Also the time period actually played, e.g. forty-five minutes for football, will be evident to all as it progressively decreases. (In an alternative embodiment, the display may start at 0.00 and increase, intermittently, to an agreed time period to be actually played).

An additional timing device (not shown) may be provided to start whenever the switch 3 disables clocks 9 and 10 and stop when they are enabled, thereby giving a total of the time for which play has been stopped.

All of the time control is under the supervision of the one man who matters, the referee. He is the one who is most adjacent to the scene of any incident likely to cause a stoppage of play and is therefore best placed to judge the beginning and end of the stoppage. Since his decisions will be seen by all, there should be no disputes, such as goals in "injury time".

Figure 2:
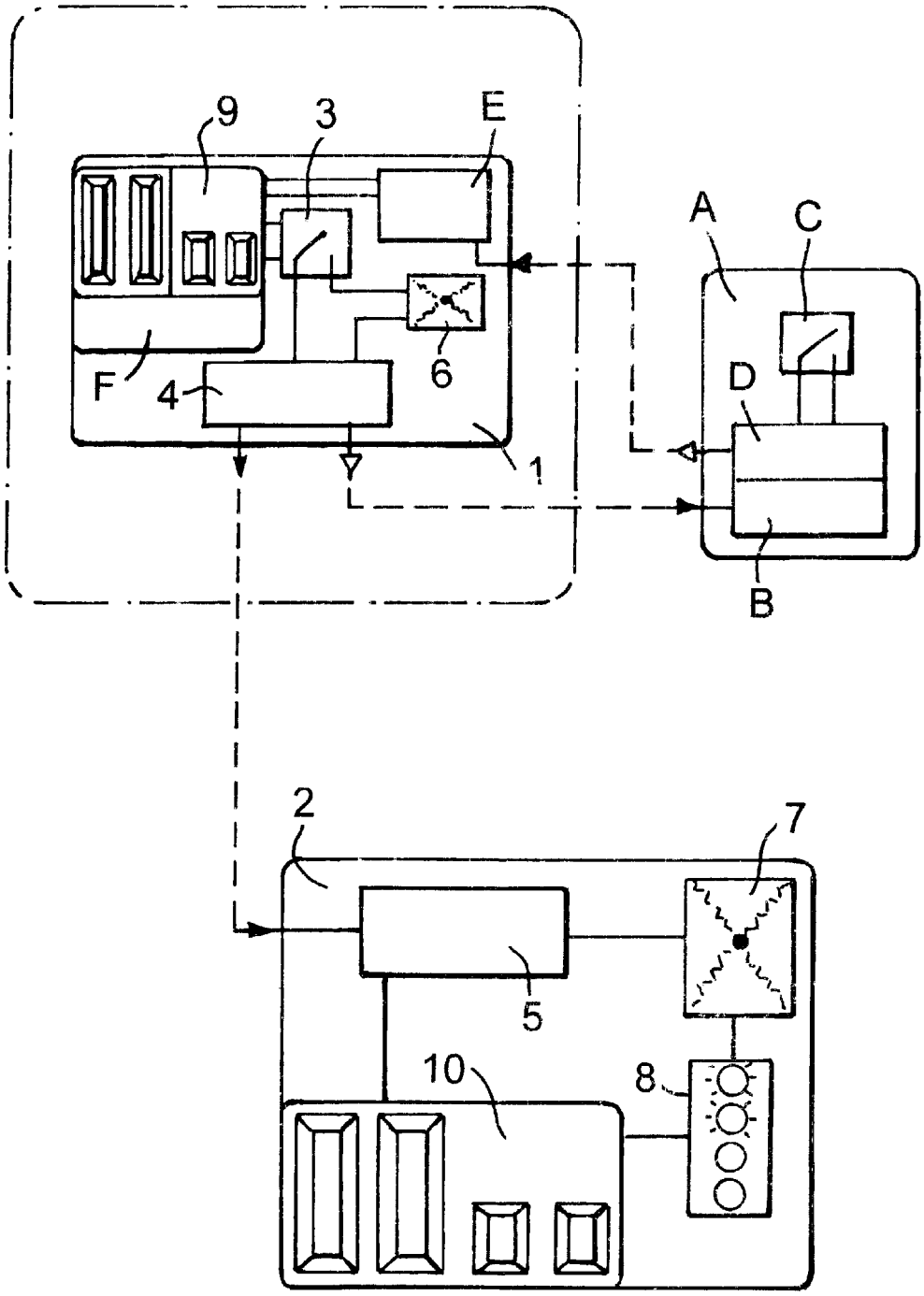
FIG. 2—shows the system course of the 4th official device in use during a game or field sport under control of one referee or umpire.
Figure 3:
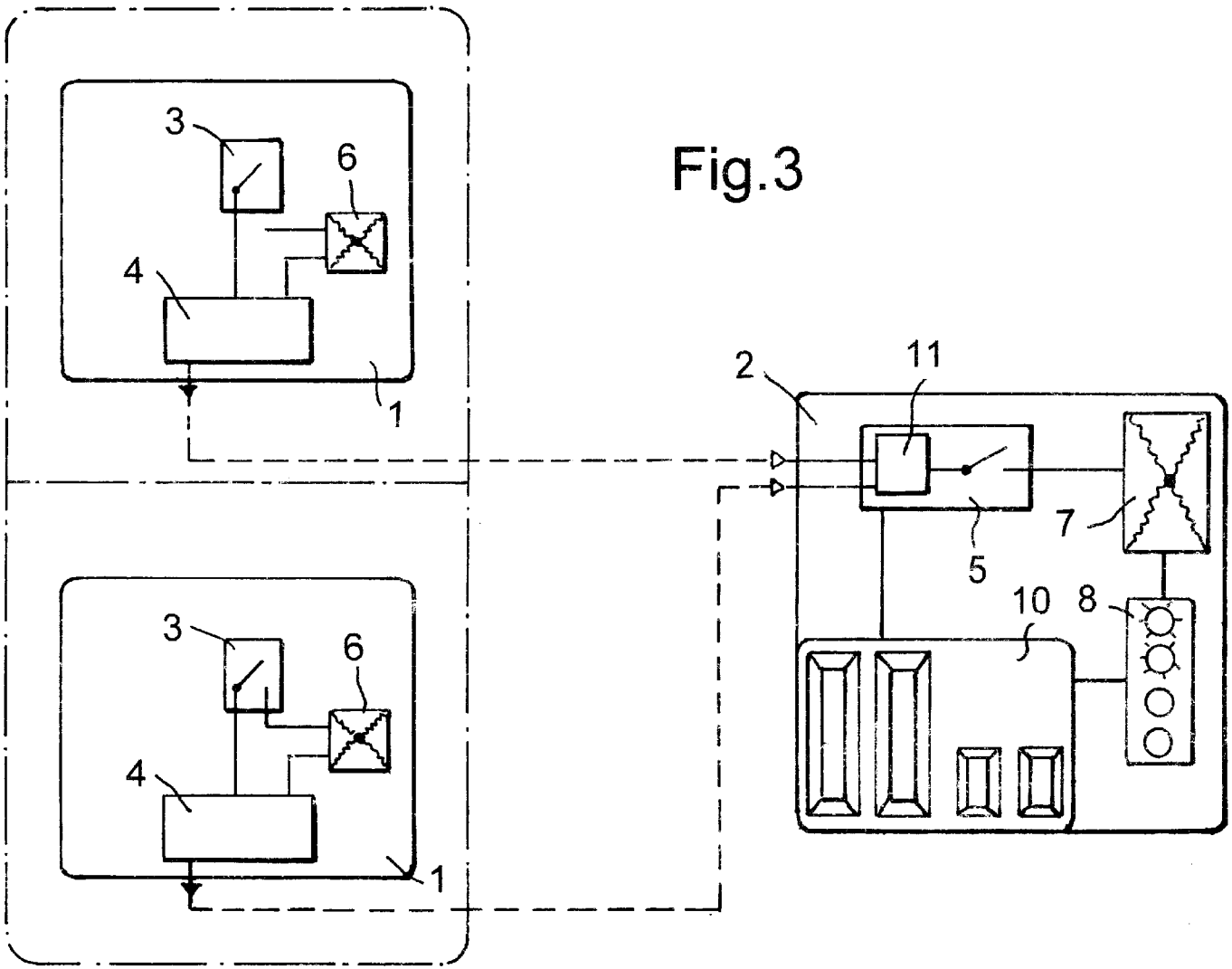
FIG. 3—shows schematically the system of the invention for a game or field sport under control of more than one referee or umpire.
Figure 4:
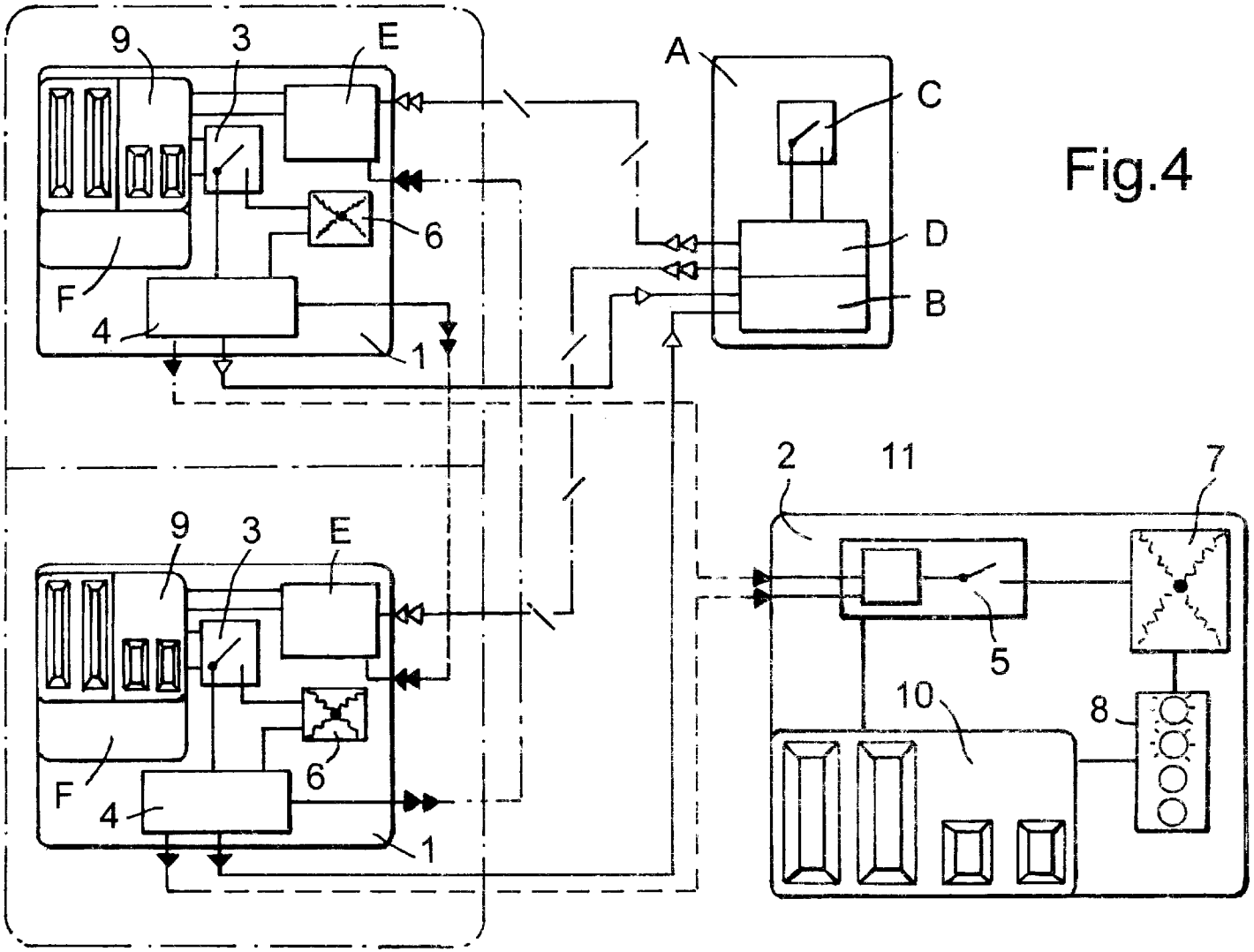
FIG. 4—shows a diagrammatic course for a system having more than one mobile device, a 4th device and a main scoreboard display under control of more than one referee or umpire.

Also there is need for more information to help in referring decisions, to this the inclusion of an extra device located outside the field of play in the vicinity of a 4th official as shown in FIG. 2. This device will operate in the following manner.

During a game or field sport an indecisive decision will have to be made. The referee or umpire presses a button on switch 3 of the mobile device, transmitter 4 will transmit a signal to receiver B on the device outside the field of play. A buzzer or light will indicate to the 4th official which pre-programmed question is being transmitted, e.g. was the ball over the line, was the player offside or was it a penalty. The 4th official can then view action replays, make a decision and press a button on switch C activating transmitter D adapted to transmit to receiver E, a pre-programmed answer and in turn displayed on display screen F.

What is claimed is:

1. A timing system for a sports game or other timed spectator event that has stoppage time, which system comprises:

at least one mobile device having a manually operated switch means and a transmitter means responsive to the switch means and adapted to transmit a wireless electro-magnetic radiation signal from the field of play;

at least one receiver means located outside of the field of play, but not surrounding the field of play, to receive said signal and emit an actuation signal in response thereto;

a timer associated with the receiver means and adapted alternately to start and stop timing in response to each actuation signal from said at least one receiver means;

time display means outside the field of play to display the output from the timer, the at least one mobile device having its own timer display means adapted to respond to operation of the switch means to provide a simultaneous timing display on the at least one mobile device; and an additional device located outside the field of play under control of an official, including a receiver adapted to receive signals from the at least one mobile device in the field of play, a switch, and a transmitter means responsive thereto and adapted to transmit signals to the at least one mobile device.

2. A timing system as claimed in claim 1, wherein the transmitted signal is radiation in the infrared or radio range.

3. A system as claimed in claim 1, wherein the mobile device is a wrist worn or pocket held unit including a transmitter means and a switch means under manual control of an official hand of a timed game being played.

4. A system as claimed in claim 1, wherein the transmitted signal is a timer start/stop signal.

5. A system as claimed in claim 1, wherein the transmitted signal is of such a selected frequency as to cause selective actuation by the receiver means of a predetermined display in addition to or replacing the timer display.

6. A system as claimed in claim 1, wherein the frequency of transmission between the controller and the receiver is so coded as to prevent interference from alternative transmission means.

7. A system as claimed in claim 1, wherein the receiver and the time display outside the field of play are mobile.

8. A system as claimed in claim 1, wherein the receiver means located outside the field of play can be adapted to accept any time means of display already in use in stadia.

9. A system as claimed in claim 6, wherein at least one signal transmits a pseudorandom number from over 16 million possible combinations and changes combination on each actuation of the mobile device switch.

10. A system as claimed in claim 1, wherein said additional device has a light or buzzer to indicate when a signal has been transmitted or received thereby.

11. A system as claimed in claim 1, wherein a signal block in the timer system allows only one mobile device to control said time system while the count-down is in stop mode.

12. A system as claimed in claim 1, wherein more than one mobile device is used in the field of play and each can transmit and receive signals to and from each other device, stop/starting a time display in said mobile devices.

13. A system as claimed in claim 8 wherein the mobile device(s) is adapted to display messages transmitted from outside the field of play.

* * * * *